US008182922B2

(12) United States Patent
Baig et al.

(10) Patent No.: US 8,182,922 B2
(45) Date of Patent: May 22, 2012

(54) COMPOSITE CEILING TILE

(75) Inventors: Mirza A. Baig, Lindenhurst, IL (US); John J. Polyner, Esko, MN (US); Terry Couch, Cloquet, MN (US)

(73) Assignee: USG Interiors, LLC, Chicago, IL (US)

( * ) Notice: Subject to any disclaimer, the term of this patent is extended or adjusted under 35 U.S.C. 154(b) by 1323 days.

(21) Appl. No.: 11/210,585

(22) Filed: Aug. 24, 2005

(65) Prior Publication Data

US 2007/0051062 A1 Mar. 8, 2007

(51) Int. Cl.
*B32B 9/04* (2006.01)

(52) U.S. Cl. ..... 428/454

(58) Field of Classification Search ..... 428/454, 428/535, 536, 220
See application file for complete search history.

(56) References Cited

U.S. PATENT DOCUMENTS

| | | | | |
|---|---|---|---|---|
| 2,526,066 | A | 10/1950 | Croce | |
| 2,828,806 | A | 6/1958 | Sabine | |
| 2,838,806 | A | 6/1958 | Sabine | |
| 3,144,376 | A | 8/1964 | Plumberg et al. | |
| 4,608,108 | A * | 8/1986 | Goll | 156/219 |
| 5,277,762 | A * | 1/1994 | Felegi et al. | 162/145 |
| 5,437,924 | A * | 8/1995 | Decker et al. | 428/318.4 |
| 5,558,710 | A | 9/1996 | Baig | |
| 5,911,818 | A * | 6/1999 | Baig | 106/698 |
| 6,299,727 | B1 * | 10/2001 | Hatanaka et al. | 162/125 |
| 6,443,256 | B1 | 9/2002 | Baig | |
| 6,443,257 | B1 * | 9/2002 | Wiker et al. | 181/290 |
| 6,616,804 | B2 * | 9/2003 | Foster et al. | 162/129 |
| 6,877,585 | B2 * | 4/2005 | Tinianov | 181/290 |
| 7,056,582 | B2 * | 6/2006 | Carbo et al. | 428/402 |
| 2002/0139611 | A1 * | 10/2002 | Baig | 181/286 |
| 2003/0134556 | A1 * | 7/2003 | Christie et al. | 442/327 |
| 2003/0145547 | A1 | 8/2003 | Kliegle et al. | |

FOREIGN PATENT DOCUMENTS

WO WO 01/48333 A1 7/2001

* cited by examiner

*Primary Examiner* — Branon Painter
(74) *Attorney, Agent, or Firm* — Pearne & Gordon LLP

(57) ABSTRACT

An improved economically produced clean room ceiling tile formed as a composite comprising a base board and a finish coated paper facer laminated to the base board. The base board is preferably made with excess thickness and is machined to a desired caliper. The machined board is sealed with a clay coating and thereafter coated with a water-based adhesive. The paper facer is laminated to the board with the water-based adhesive and is finish coated with a water-based wet scrubbable coating. The paper facer is easy to laminate, exhibits excellent coverage of surface defects in the base board surface, is fully compatible with the water-based finish coating, and contributes to the sag resistance of the tile.

2 Claims, 2 Drawing Sheets

COMPOSITE CEILING TILE

BACKGROUND OF THE INVENTION

The invention relates to improvements in tiles for suspended ceilings and, in particular, to a composite multilayer ceiling tile.

PRIOR ART

Various suspended ceiling tile constructions have been commercialized. One product line of this general class of goods are so-called "clean room" tiles used in commercial kitchens, restaurants, hospitals, pharmaceutical environments, and other commercial environments where there is a special need to keep the ceiling free of dust, grease, dirt, or other material that might be air entrained, splashed, sprayed, propelled, or otherwise directed onto the ceiling. A common construction of a clean room tile comprises a board on which a vinyl sheet or a combination of vinyl and metal foil sheets is/are laminated to a side of the board that forms, in the installed orientation, the exposed visible face of the tile. The vinyl sheet, in both constructions, provides a surface that can be wet wiped or scrubbed from time-to-time during its service life. The vinyl or vinyl/foil facers add a significant cost to the ceiling tile. When vinyl alone is used, thinner sheets suffer from "strike-through", a condition where surface imperfections in the associated face of the board are visibly reflected or telegraphed through the sheet.

SUMMARY OF THE INVENTION

The invention provides a clean room ceiling tile that is economical to produce and offers improvements in appearance and sag resistance when compared to prior art constructions. The tile of the invention in its preferred form is a composite of relatively lightweight board stock, a paper facer, and a liquid applied finish coating.

The board, preferably, has a side towards the finish side of the tile that is machined by planing, grinding, sanding or like, to obtain a uniform thickness and relatively smooth finish. The paper facer is relatively thick and inextensible compared to previously used vinyl facer materials. The character of the paper and process by which it is laminated, substantially eliminate the risk of strike through where surface imperfections in the form of either macroscopic elevations or depressions exist on the machined side of the board. The paper facer, joined to the board, is coated in situ with a water-based paint-like material to create the finished visible face of the tile and provide a wet abrasion resistant or scrubbable surface.

Besides reducing cost, the disclosed tile construction can improve the sag resistance of a tile. The effectiveness of this characteristic can be advantageously improved when the machine direction of the paper, i.e. the direction it was conveyed when being made, is arranged at right angles to the machine direction of the board. In this condition, the strength of both the board and paper facer compliment one another to improve sag resistance in both horizontal directions. Apart from so-called "clean room" ceiling tile, the invention can be used to produce tile intended for ordinary service where there is no requirement that the visible surface be scrubbable.

DESCRIPTION OF THE PREFERRED EMBODIMENT

Figure 1:
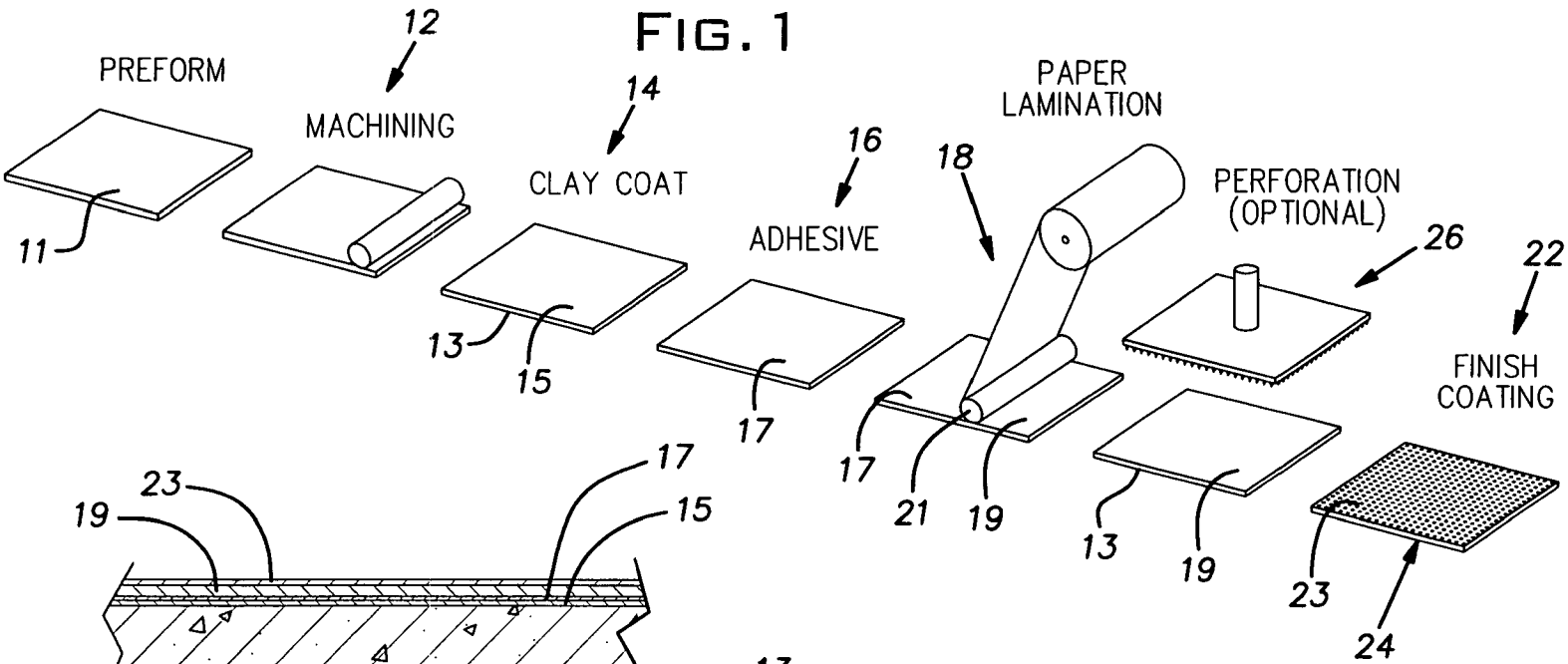
FIG. 1 is a schematic representation of an exemplary process used to make the composite ceiling tile of the invention.
Figure 2:
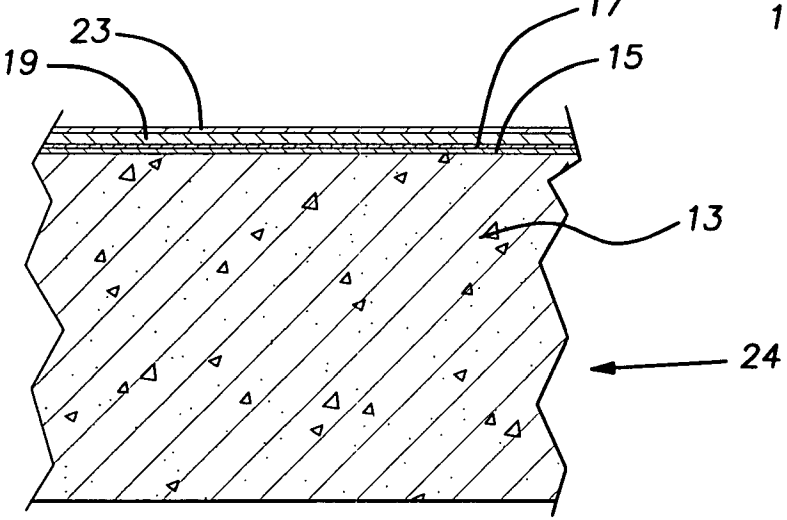
FIG. 2 is a fragmentary cross-sectional view of a composite tile of the invention with certain layers exaggerated in thickness for purposes of illustration, the tile being shown inverted from the orientation in which it is used.

A preform board 11 is manufactured by any suitable known process and formulation such as disclosed in U.S. Pat. No. 6,443,256, or disclosed in patents cited therein. The material forming the preform board is formulated to provide fire resistance and sound absorbing properties as well as, preferably, exhibiting a relatively low density of, for example, from about 18 lbs. to about 22 lbs. per cubic foot. Typically, the preform board 11 will include a binder such as starch or latex and, by way of example, mineral fiber, expanded perlite, cellulose fiber, all of which are sufficiently hydrophillic to enable the board to be formed from a water-based slurry or paste. For instance, the board may be formed by a water felting process. Expanded perlite or other low density material is ideally employed to keep the density of the board 11 relatively low. The illustrated preform board can have nominal dimension of 4'×4' after being cut from a considerably larger plank. The preform 11, due in large part to its formulation including cellulose fiber, mineral wool and overall low density, can be difficult to control in its dry thickness so that it is made to a thickness somewhat greater than its desired finished thickness. The preform board 11 is conveyed to a machining station schematically illustrated at 12, where its thickness is reduced to a uniform desired thickness. For example, the original preform board 11 can have a thickness of, for example, about 0.610" to 0.620" and can be reduced to a nominal thickness of, for example, about 0.500". The machining operation at the station 12 can involve planing, grinding, sanding, or like processes to remove excess thickness. The board can have any desired uniform finished thickness ranging, preferably, from about 0.5" to 0.8". The invention can be used with non-machined boards where they are produced with a uniform thickness and at least one relatively smooth side for laminating.

The machined board, designated 13, after being vacuumed or otherwise having removed a portion of dust-like particles produced in the machining process, is preferably coated with a thin layer of clay 15 deposited from a water suspension to further improve the surface smoothness of the board and to seal in any residual machining dust which would otherwise impede subsequent lamination steps. The clay water dispersion is typically sprayed on the board 13, but various other application methods such as roll-coating can be used. The clay water dispersion is dried in a convection oven or other force drying procedure and is conveyed to a station 16 where adhesive is applied to the machined, clay-coated surface of the board 13. If the board surface conditions permit, the clay coating 15 may be omitted.

At the adhesive applying station 16, a suitable water soluble or water-based adhesive is applied by a known technique such as roll-coating. Other techniques such as spraying can be used to apply the adhesive coating, designated 17. The adhesive is allowed to air cure to a tacky condition, which cure may be accelerated by the addition of heat from heat lamps, heated forced air, or other suitable known technique. From the adhesive application station 16, the board 13 is conveyed to a laminating station 18 where a paper facer 19 is laminated to the machined clay-coated face of the board 13. If desired, the adhesive 17, as an alternative to being first applied to the clay-coated face of the board 13, can be first applied to the paper facer material 19 or can be applied to both the clay-coated board face and the paper facer. The paper facer 19 is uniformly pressed onto the board 13 by a rubber roller 21 or other known medium to laminate the paper facer to the board. The paper facer 19, which typically is supplied from a roll, is suitably cut to size on the board 13.

From the laminating station 18, the board 13 and paper facer 19 are conveyed to a finish coating station 22. Preferably, the board and paper lamination is cut to a finish size, typically, nominally 2'×4' or 2'×2' before finish coating. At the coating station 22 a durable water-based paint-like coating 23 is applied to the outer surface of the paper facer 19. The finish coat 23 can be sprayed, rolled, flooded, or otherwise deposited onto the outer surface of the facer 19. The finish coat 23 can be any commercially available washable water-based latex paint or similar formulation. A typical coating 23 can have about 50% solids comprising clay, delaminated clay, calcined clay, calcium carbonate, titanium dioxide, and a suitable latex binder capable of achieving a cohesive bond between the coating and the paper facer substrate 19. The coating can be applied at a wet weight of about, for example, 15 to 30 grams per square foot. The binder is selected of a material capable of producing, when the coating 23 is dried, a wet scrub-resistant coating, for example, capable of passing ASTM Test No. 4213 using a Gardner Heavy Duty Wear Tester (Gardner Laboratory, Inc., Maryland). The finish coat 23 is dried by conveying the paper laminated board 13 through a convection oven or by other force drying techniques.

When the finish coat 23 is dry, a clean room ceiling tile 24 is completed and ready for packaging and distribution. If desired, the ceiling tile 24 can be perforated at an optional perforation station 26 prior to treatment at the coating station 22 or after treatment at the coating station to improve the sound-absorbing performance of the tile 24.

Ceiling tile produced in accordance with the disclosed materials and processes exhibits an excellent finish since the finish coat 23 is free of any strikethrough of small but difficult to avoid surface imperfections in the machined face of the board 13. This is due to the excellent covering ability of the paper facer 19. The paper facer 19 can be the type of paper used to make gypsum board and is typically made on a cylinder paper forming machine or a Fordrineier paper forming machine. The paper facer 19 can have a thickness that, for example, is about at least 4 mils (0.004") and, more preferably, is about 11 to 13 mils (0.011" to 0.013"). Various other types of papers, such as Kraft paper, are contemplated. The ability of the paper facer to bridge macroscopic voids, depressions, and elevations in the machined surface of the board is due in part to the inherent swelling and loosening of cellulose fibers of the paper when wetted by the water-based adhesive 17. The adhesive, by way of example, can be applied at a wet weight of about 10 grams per square foot. When the associated moisture migrates from the interface of the adhesive, the paper fibers in this area shrink from their swelled condition and minutely self-rearrange to bridge voids, fill depressions and accommodate projections, such actions serving to mask any slight, often unavoidable surface imperfections on the laminated board face whether it be machined, as disclosed, or otherwise formed. The paper facer 19 is considerably easier to laminate to the board 13 than is a vinyl sheet since the paper facer readily absorbs at least some of the moisture of the water-based adhesive 17 to accelerate and complete the bond and cure of the adhesive. This feature can potentially reduce the amount of adhesive required to construct the tile from that need in prior art tile constructions.

The disclosed paper faced tile 24 of the invention exhibits a surprising improvement in sag resistance which is comparable to prior art tile constructions using vinyl facers. It is believed that this phenomena is due at least in part to the tension imparted to the paper facer 19 when it dries from the water of the adhesive 17 and similarly when it dries from the water of the finish coating 23. Moreover, the paper facer is considerably more resistant to elongation and creep under tensile stress than is a vinyl film of comparable thickness. This paper characteristic of relative inextensibility has the potential for greatly increasing the sag resistance of the tile 24, it being appreciated that when the tile is installed, the finish coat 23 is facing downwardly towards the interior of a room and the paper facer 19 is in tension when the weight of the tile urges the tile to sag. The performance of the tile can be improved where the machine direction of the paper, i.e. the direction the paper was conveyed while it was being formed, is arranged to be perpendicular to the machine direction of the board, i.e. the direction in which the board was conveyed while it was being formed.

The water-based coating 23, when having a formulation of or like a commercial latex (water-based) paint is characterized by cross-linking or coalescing of the latex when dried which thereafter renders it stable when wetted and/or scrubbed with water. Thus, from time-to-time, the coating 23, representing the visible face of the tile 24 when in service, can be cleaned with a damp cloth without significant degradation. Moreover, the surface coating 23 can be easily and successfully repainted, typically with ordinary latex paint, to completely renew its appearance and/or change its color. Paper faced tiles of the invention, unlike vinyl or foil faced tiles, can be ground-up and recycled at a manufacturing plant where they fall quality or performance standards.

Apart from so-called "clean room" ceiling tile, the invention can be used to produce tile intended for ordinary service where there is no requirement that the visible surface be scrubbable. Such tiles have a board density from about 12 to about 22 lbs. per cubic foot and are generally made as described above. The paper facer can be adhesively attached, as disclosed, with or without the described clay coating, to the machined surface of a board of any commercially used density and thickness. The paper facer, particularly where it is manufactured in a relatively white color through bleaching and/or composition, can reduce the number of coats of paint required to produce a satisfactory finish on the visible side of the tile. Where scrubability is unimportant, the paint used to coat the paper facer can be less durable. The adhered paper facer can be textured, typically after being preliminarily painted, with the board with conventional techniques such as with a pattern roll. Additionally, the textured or patterned paper facer can be perforated, normally after final painting, as described to achieve a desired sound absorption level.

Figure 3:
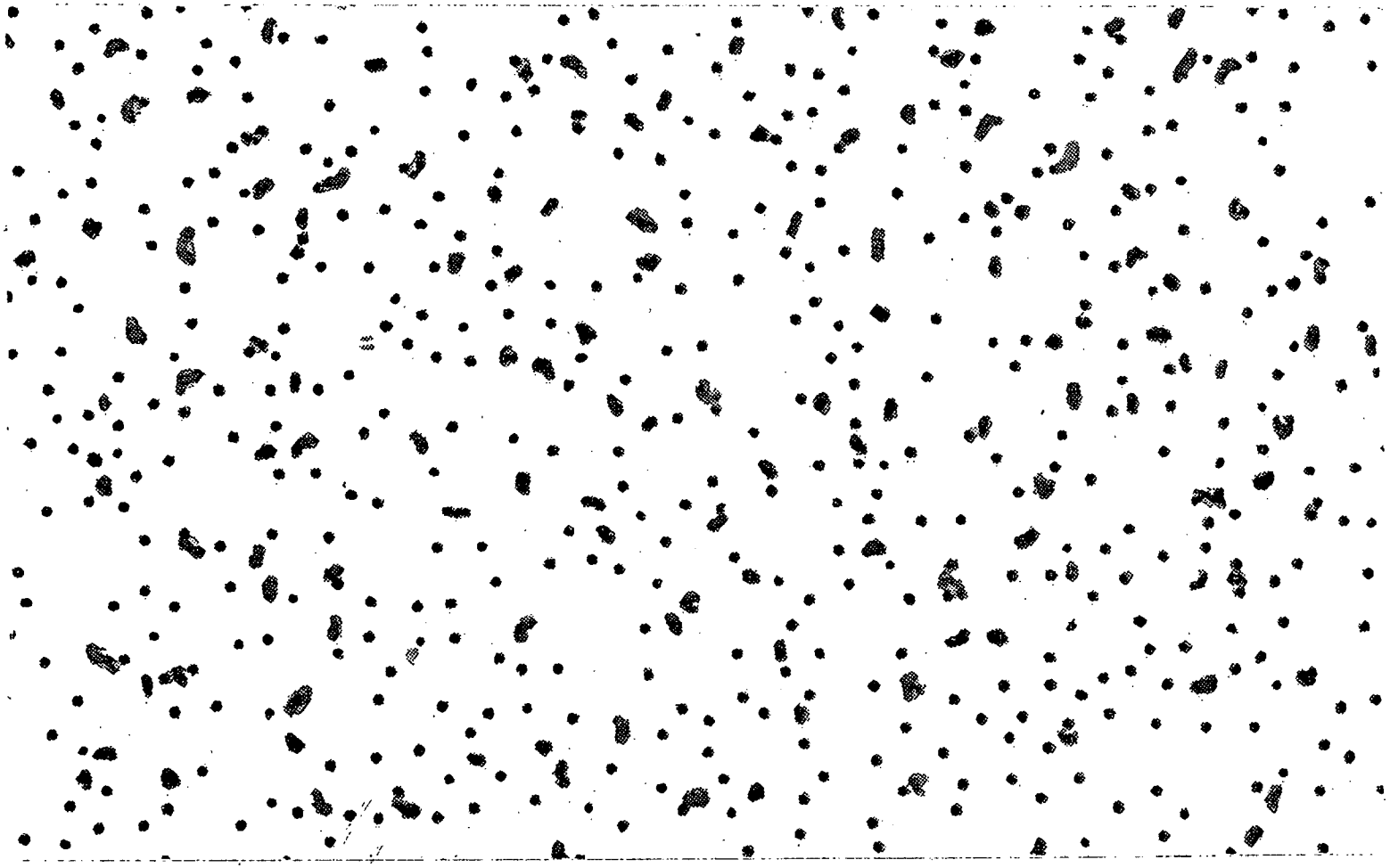
FIG. 3 is a reproduction of a representative small area (approximately 4¾"×8") of a printed pattern on the surface of a tile.

The paper facer can be printed with designs or images before or after it is laminated to the board and whether or not the paper facer is first painted after lamination. Referring to FIG. 3, there is shown a sample of an area of a finished face of a ceiling tile constructed in the manner described hereinabove. As described, the laminated paper facer preferably is first finished with a paint-like coating. Thereafter, the dried paint-like coating is printed with a suitable ink, preferably on the tile production line, with a desired pattern. The pattern can be printed in half-tones, as shown, for a desired appearance. Essentially any type of printed pattern or image and color or colors can be used. The tile at the printed, finished side, can be perforated before or after it is printed to improve its sound absorption capability. Where the quality of the paper facer is satisfactory, it can be used without painting or coating. The paper facer, as indicated above, is effective in improving the sag resistance of the tile.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A composite ceiling tile having a machined surface, a clay coating on the machined surface, a water-based adhesive bonding a paper facer to the clay coating, the paper facer being coated in situ, after the paper facer is laminated to the clay coating, with a water-based coating that dries to a condition that is scrubbable with a wet cloth, the paper facer being relatively inextensible whereby with the tile oriented with the scrubbable coating facing downwardly, the sag resistance of the tile is improved by the presence of the paper facer.

2. A composite ceiling tile comprising a manufactured rigid board formed at least partially of hydrophillic material dried from a water slurry or paste, a paper facer laminated on the board, a water-based adhesive bonding the paper facer to the board, and a water scrubbable coating on an outer surface of the paper facer formed in situ on such outer surface from a water-based liquid coating applied to the outer surface and dried, the board and paper being each made in a respective process that aligns its structure with a direction corresponding to a machine direction through which they are conveyed when being manufactured, the paper facer being laminated on the board with its machine direction perpendicular to the machine direction of the board.

* * * * *